US010347220B1

(12) United States Patent
Jiang et al.

(10) Patent No.: US 10,347,220 B1
(45) Date of Patent: Jul. 9, 2019

(54) DATA COMPRESSION AND DECOMPRESSION METHOD FOR DEMURA TABLE

(71) Applicant: Wuhan China Star Optoelectronics Semiconductor Display Technology Co., Ltd., Wuhan, Hubei (CN)

(72) Inventors: Jilong Jiang, Guangdong (CN); Nian Tian, Guangdong (CN)

(73) Assignee: WUHAN CHINA STAR OPTOELECTRONICS SEMICONDUCTOR DISPLAY TECHNOLOGY CO., LTD., Wuhan (CN)

( * ) Notice: Subject to any disclaimer, the term of this patent is extended or adjusted under 35 U.S.C. 154(b) by 0 days.

(21) Appl. No.: 15/979,917

(22) Filed: May 15, 2018

Related U.S. Application Data

(63) Continuation of application No. PCT/CN2018/072863, filed on Jan. 16, 2018.

(30) Foreign Application Priority Data

Dec. 29, 2017 (CN) ..... 2017 1 1484682

(51) Int. Cl.
*G09G 5/10* (2006.01)
*G09G 5/393* (2006.01)

(52) U.S. Cl.
CPC ..... *G09G 5/393* (2013.01); *G09G 5/10* (2013.01); *G09G 2300/043* (2013.01); *G09G 2320/0233* (2013.01); *G09G 2320/0285* (2013.01); *G09G 2320/0626* (2013.01)

(58) Field of Classification Search
None
See application file for complete search history.

(56) References Cited

U.S. PATENT DOCUMENTS

2018/0158434 A1* 6/2018 Bian ..... G09G 5/06
2018/0191371 A1* 7/2018 Tao ..... G09G 3/36

* cited by examiner

*Primary Examiner* — Joni Richer
(74) *Attorney, Agent, or Firm* — Hauptman Ham, LLP

(57) ABSTRACT

Disclosed is a data compression method for DeMura table, including steps of: acquiring an original DeMura table of a display panel; designating compensation data in four neighboring rows in the original DeMura table as a fragment to be fetched in a fetch cycle and periodically fetching compensation data per fetch cycle; permuting fetched compensation data so as to create a compressed DeMura table; and storing the compressed DeMura table in a storage device, wherein the step of periodically fetching compensation data includes sub-steps of: fetching the compensation data in odd-numbered columns from the first row of the original DeMura table; and fetching the compensation data in even-numbered columns from the third row and fetching the compensation data in the first column from the third row of the original DeMura table. Also disclosed is a data decompression method for DeMura table. The invention can save storage space and lower cost.

13 Claims, 8 Drawing Sheets

DATA COMPRESSION AND DECOMPRESSION METHOD FOR DEMURA TABLE

RELATED APPLICATIONS

This application is a continuation application of PCT Patent Application No. PCT/CN2018/072863, filed Jan. 16, 2018, which claims the priority benefit of Chinese Patent Application No. 201711484682.8, filed Dec. 29, 2017, which is herein incorporated by reference in its entirety.

FIELD OF THE DISCLOSURE

The invention relates to the field of compensation technology for display panel, and more particularly to a data compression and decompression method for DeMura table.

BACKGROUND

Mura effect appears to be the defects in the image caused by the non-uniform brightness in a display panel. DeMura actually means a process for compensating the mura effect. Concretely speaking, the DeMura process is done by photoing display screens with different brightness for obtaining the Mura information of the display panel, and fetching Mura data from the Mura information and amending the Mura data by some algorithms. In the end, a DeMura table is created for the hardware (such as a processor) to adapt the display performance. Generally speaking, the fetching of the Mura information is accomplished by a camera, and the Mura information is processed by a personal computer, thereby creating a DeMura table. Finally, the DeMura table is stored in a storage device (such as a flash device). The conventional DeMura processing is illustrated with reference to the block diagram of FIG. 1.

Nowadays, because of the requirement of high display performance, the resolution of the display panel tends to increase. This would cause the data in the DeMura table to grow, and thus would cause the size of the DeMura table to rise. What is more, the size of the DeMura table is a determinative factor for the space of the storage device. Hence, the storage capacity of the storage device is also required to expand, which would in turn elevate the cost.

SUMMARY

The solution proposed by the invention is to provide a data compression and decompression method for DeMura table. Thus, the invention is able to efficiently compress the DeMura table for the purpose of saving cost.

To this end, a first aspect of the invention is directed to the provision of a data compression method for DeMura table, which includes the steps of:

acquiring an original DeMura table of a display panel;

based on the original DeMura table, designating compensation data in four neighboring rows in the original DeMura table as a fragment to be fetched in a fetch cycle and periodically fetching compensation data per fetch cycle;

permuting fetched compensation data in sequence so as to create a compressed DeMura table; and storing the compressed DeMura table in a storage device;

wherein the step of periodically fetching compensation data per fetch cycle includes sub-steps of:

fetching the compensation data in odd-numbered columns from the first row of the original DeMura table; and fetching the compensation data in even-numbered columns from the third row and fetching the compensation data in the first column from the third row of the original DeMura table.

In accordance with the invention, the method starts periodically fetching compensation data from the first row of each fragment per fetch cycle.

In accordance with the invention, the method starts periodically fetching compensation data from the first row of each fragment per fetch cycle.

In accordance with the invention, the data compression method for DeMura table further includes the step of:

if the last k rows of the original DeMura table is not fetched through all of the fetch cycles, compulsorily fetching compensation data from the last k rows with reference to the fetching manner for corresponding rows for each fetch cycle, where k is a positive integer smaller than 4.

In accordance with the invention, the step of periodically fetching compensation data per fetch cycle further comprising the sub-step of:

if the compensation data in the last column from the first row or the third row of each fragment are not fetched, compulsorily fetching the compensation data in the last column from the first row or the third row.

In accordance with the invention, the data compression method for DeMura table further includes the step of:

if the total number of rows in the original DeMura table is an even number, compulsorily making the fetching manner for the last row the same with the fetching manner for the second-to-last row.

A second aspect of the invention is directed to the provision of a data decompression method for DeMura table, which includes the steps of:

fetching the total number of rows N and the total number of columns M of an original DeMura table, wherein both N and M are a positive integer larger than or equal to 2;

fetching compensation data from a compressed DeMura table;

interpolating at most a first to-be-filled data between every two adjacent compensation data of the compressed DeMura table along a row-wise direction, so as to obtain data in M columns;

interpolating at most a to-be-filled row between every two adjacent rows of compensation data of the compressed DeMura table along a column-wise direction, so as to obtain data in N rows, wherein each interpolated to-be-filled row includes second to-be-filled data in M columns; and calculating compensation value of part of the second to-be-filled data by means of three compensation data in two adjacent rows, wherein locations of the three compensation data form an isosceles triangle surrounding the second to-be-filled data.

In accordance with the invention, the step of interpolating at most a first to-be-filled data between every two adjacent compensation data of the compressed DeMura table along a row-wise direction so as to obtain data in M columns includes sub-steps of:

determining whether M is even or odd;

if M is even, interpolating a first to-be-filled data between every two adjacent compensation data in the range from the first column to the second-to-last column in odd-numbered rows of the compensation data so as to obtain data in M columns, and interpolating a first to-be-filled data between every two adjacent compensation data in the range from the second column to the last column in even-numbered row of the compensation data so as to obtain data in M columns; and if M is odd, interpolating a first to-be-filled data between every two adjacent compensation data in odd-numbered rows of the compensation data so as to obtain data in M columns, and interpolating a first to-be-filled data between every two adjacent compensation data in the range from the second column to the second-to-last column in even-numbered row of the compensation data so as to obtain data in M columns.

In accordance with the invention, the step of interpolating at most a to-be-filled row between every two adjacent rows of compensation data of the compressed DeMura table along a column-wise direction, so as to obtain data in N rows includes sub-steps of:

determining whether N is even or odd;

if N is odd, interpolating a to-be-filled row between every two adjacent rows of compensation data along the column-wise direction; and if N is even, interpolating a to-be-filled row between every two adjacent rows of compensation data along the column-wise direction in the range from the first row to the second-to-last row.

In accordance with the invention, the step of calculating compensation value of part of the second to-be-filled data by means of three compensation data in two adjacent rows includes the sub-step of:

calculating the compensation value of each second to-be-filled data in the range from the second column to the (M−1)th column in each to-be-filled row by means of three compensation data in two adjacent rows.

In accordance with the invention, the data decompression method for DeMura table further includes the steps of:

calculating the compensation value of each first to-be-filled data by means of two compensation data in two adjacent columns in the same row;

calculating the compensation value of the second to-be-filled data in the first column and the compensation value of the second to-be-filled data in the last column in each to-be-filled row by means of two adjacent compensation data in the same column; and obtaining a decompressed DeMura table.

By implementing the embodiment of the invention, the following benefits can be obtained:

The data compression method for DeMura table of the invention includes the following steps of: based on the original DeMura table, designating compensation data in four neighboring rows in the original DeMura table as a fragment to be fetched in a fetch cycle and periodically fetching compensation data per fetch cycle; fetching the compensation data in odd-numbered columns from the first row of the original DeMura table; and fetching the compensation data in even-numbered columns from the third row and fetching the compensation data in the first column from the third row of the original DeMura table. As a result, the size of the compressed DeMura table is much smaller than that of the original DeMura table, so that the required storage space can be reduced and the cost can be lowered.

BRIEF DESCRIPTION OF THE DRAWINGS

To illustrate the technological scheme embodying the embodiment of the invention or the prior art in a clear manner, the accompanying drawings showing the embodiment of the invention or the prior art will be briefed in the following. Apparently, the accompanying drawings stated below are merely affiliated to some embodiments of the invention. An artisan having ordinary skill in the art can devise other drawings based on the accompanying drawings without exerting non-inventive laboring. In the figures.

DETAILED DESCRIPTION OF PREFERRED EMBODIMENTS

Next, the technological scheme embodying the embodiment of the invention will be described with reference to the accompanying drawings in a clear and complete manner. Apparently, the embodiment described herein does not exhaustively encompass all possible embodiments of the invention. Based on the embodiment of the invention disclosed herein, all other embodiments devised without inventive laboring by an artisan having ordinary skill in the art should be within the scope of the invention.

The phrases of "including" and "having" used throughout the specification and claims and their derivatives are intended to mean non-exclusive encompassment. For example, the sentence "including a series of steps or the process, method, system, product, equipment" does not limit the scope to a step or an element disclosed herein. On the contrary, the phrases of "including" and "having" should encompass undisclosed steps or elements or alternatives to the step, method, system, product, or equipment. Also, the phrases of "first", "second", and "third" are purported to distinguish different things instead of being used to describe a specific series of things.

The First Embodiment

A first embodiment of the invention provides a data compression method for DeMura table. Please refer to FIG. 2 to FIG. 4*c*. The data compression method includes the steps of:

S110: Acquiring the original DeMura table of the display panel.

In this embodiment, an external camera is used to photograph the Mura pattern in the grayscale screen of the display panel. The difference between the brightness in the periphery of the display panel and the brightness in the central area of the display panel is calculated by way of comparison. Concretely speaking, the areas which are brighter than the central area have to demote their grayscale for lowering the brightness, while the areas which are darker than the central area have to promote their grayscale for heightening the brightness. In this way, an original DeMura table is generated. The compensation data in the DeMura table corresponds to the sub-pixels of the display panel so as to compensate the brightness for each sub-pixel. In this embodiment, the DeMura table is comprised of compensation data in N rows and M columns.

S120: Based on the original DeMura table, designating the compensation data in four neighboring rows as a fragment to be fetched in a fetch cycle and periodically fetching compensation data per fetch cycle.

Figure 1:
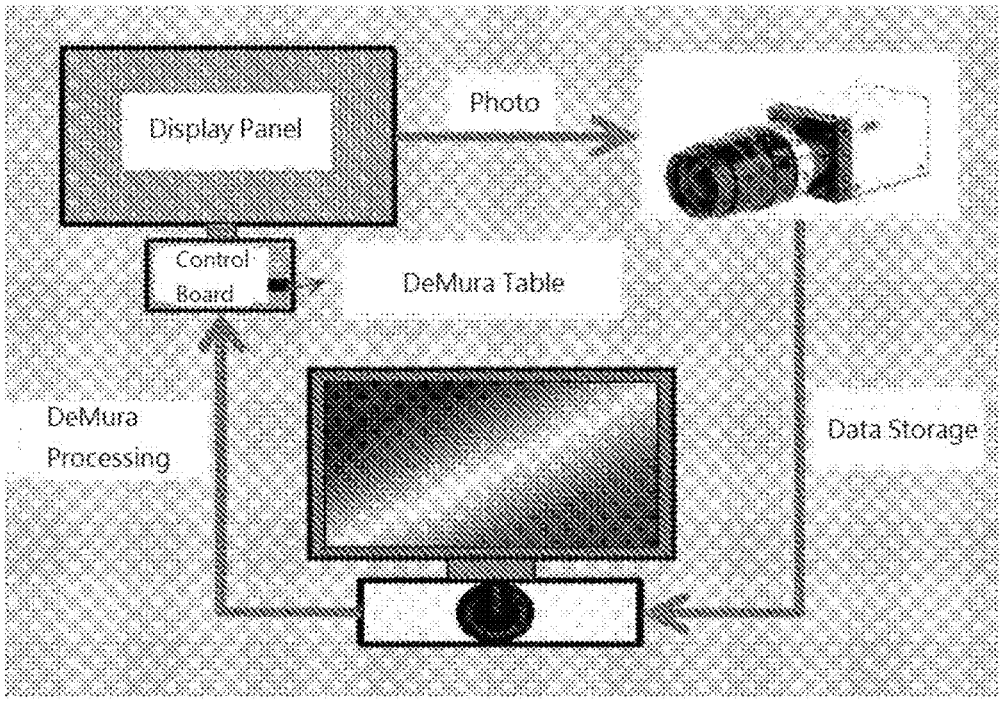
FIG. 1 (PRIOR ART)
FIG. 1 is a block diagram illustrating the manner for compensating the Mura defects by DeMura technique according to the prior art.
Figure 2:
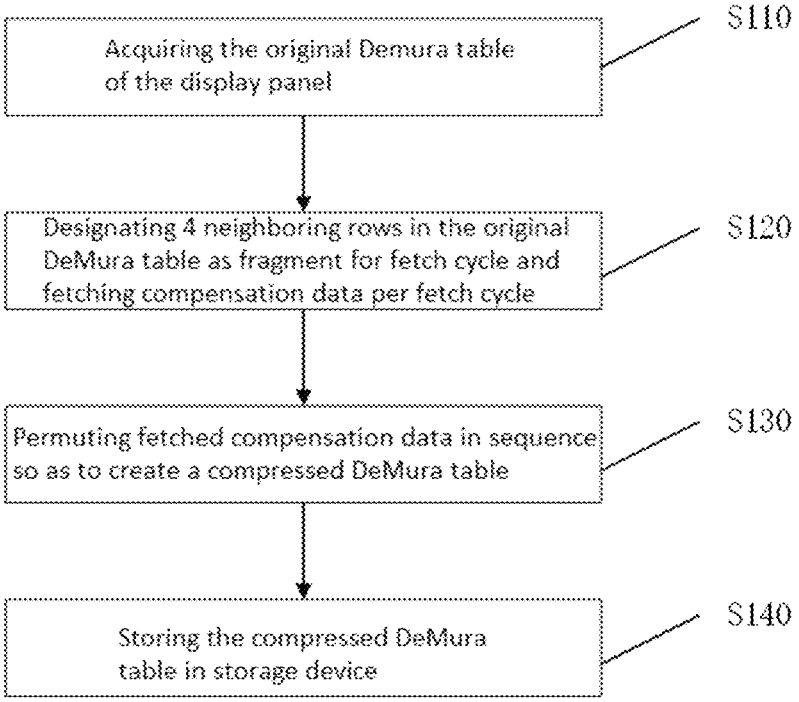
FIG. 2 is a flow chart illustrating the data compression method for DeMura table according to a first embodiment of the invention.
Figure 3:
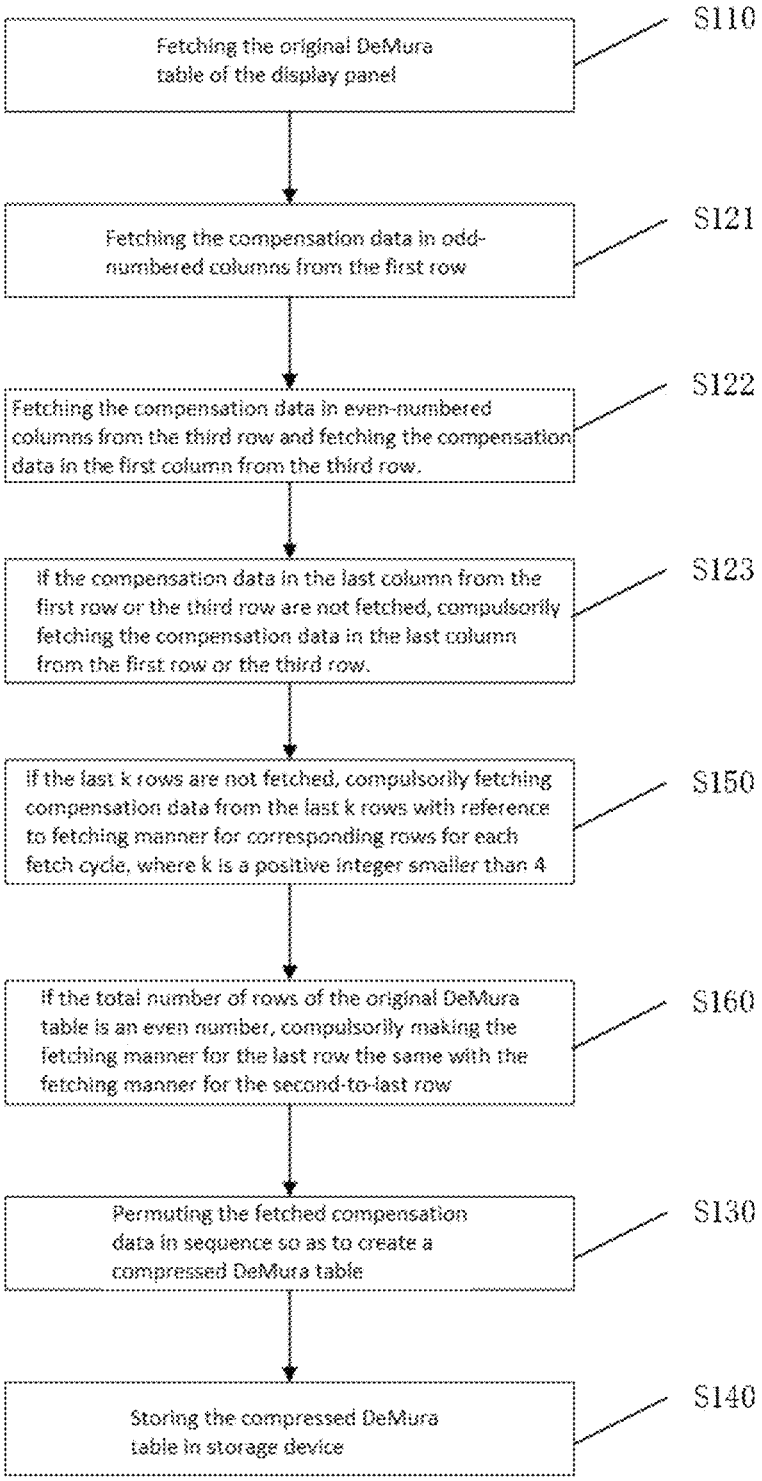
FIG. 3 is a flow chart illustrating the details of the data compression method for DeMura table according to a first embodiment of the invention.
Figure 4A:
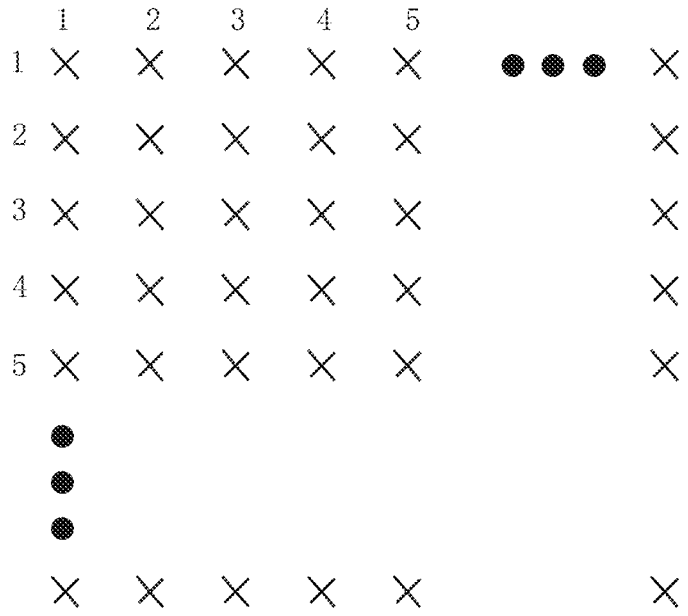
FIG. 4*a* is schematic diagram showing an original DeMura table according to a first embodiment of the invention.
Figure 4B:
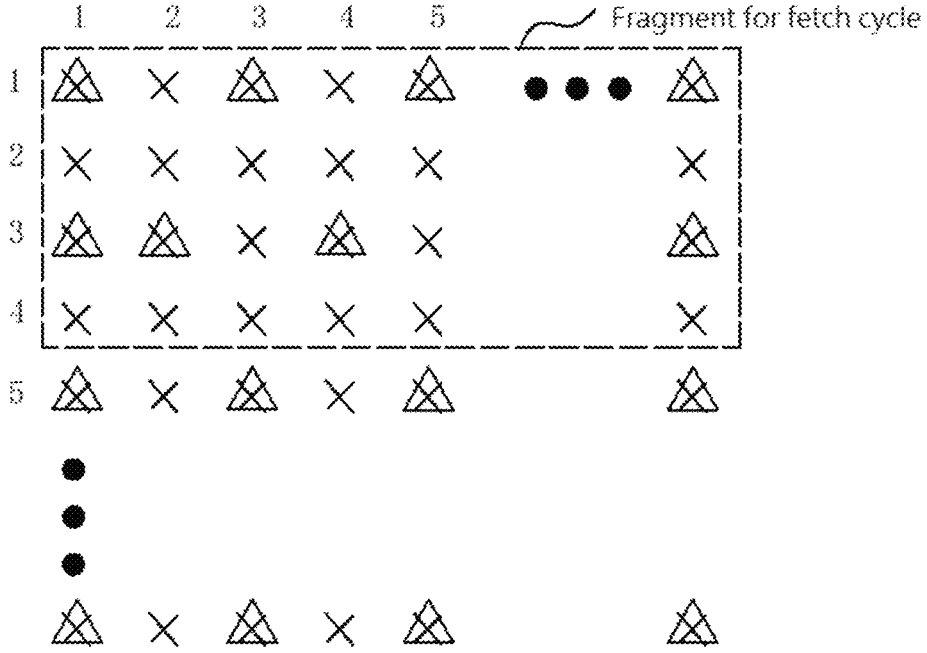
FIG. 4*b* is schematic diagram showing the manner for compressing an original DeMura table according to a first embodiment of the invention.

Please refer to FIG. 4*b*. In order to reduce the storage space occupied by the compensation data, for example, the storage space of a flash device, in this embodiment the display panel designates four neighboring rows of the original DeMura table as a fragment to be fetched in a single fetch cycle based on the compensation data in the original DeMura table. In this embodiment, the fetch cycle commences the fetching operation from the compensation data of the first row in the fragment in the original DeMura table for each fetch cycle. That is, the compensation data from the first row to the fourth row are fetched in the first fetch cycle, and the compensation data from the fifth row to the eighth row are fetched in the second fetch cycle, and the compensation data from the ninth row to the twelfth row are fetched in the third fetch cycle, and so on. The fetching operation will periodically iterate until the compensation data of the last four rows are fetched in the last fetch cycle. Here, the compensation data of four rows are set to the fragment for fetch cycle. Moreover, the compensation data of the same row in different fragment is fetched with the same fetching manner. For example, the fetching manner for the compensation data of the fifth row, the ninth row, are the same with the fetching manner for the compensation data of the first row; the fetching manner for the compensation data of the sixth row, the tenth row, . . . , are the same with the fetching manner for the compensation data of the second row; the fetching manner for the compensation data of the seventh row, the eleventh row, are the same with the fetching manner for the compensation data of the third row; and the fetching manner for the compensation data of the eighth row, the twelfth row, are the same with the fetching manner for the compensation data of the fourth row.

Concretely speaking, in this embodiment the step S120 further includes sub-steps of:

Step S121: Fetching the compensation data in odd-numbered columns from the first row.

Please refer to FIG. 4*b*. In each fetch cycle, the compensation data in odd-numbered columns from the first row (which are respectively labeled with a triangle) are fetched. That is, the compensation data in the first, third, fifth, seventh, ninth, . . . columns from the first row will be fetched for each fetch cycle. In the meantime, the compensation data in the second, fourth, sixth, eighth, tenth, . . . columns will not be fetched.

Step S122: Fetching the compensation data in even-numbered columns from the third row and fetching the compensation data in the first column from the third row.

Please refer to FIG. 4*b*. In each fetch cycle, the compensation data in even-numbered columns from the first row (which are respectively labeled with a triangle) are fetched. That is, the compensation data in the second, fourth, sixth, eighth, tenth, . . . columns from the third row will be fetched for each fetch cycle. In addition, the compensation data in the first column from the third row (which is labeled with a triangle) are fetched for each fetch cycle. Meanwhile, compensation data in the third, fifth, seventh, ninth, . . . columns will not be fetched.

In this embodiment, in order to facilitate the subsequent decompression process, the step S120 further includes a sub-step of:

S123: If the compensation data in the last column from the first row or the third row are not fetched, compulsorily fetching the compensation data in the last column from the first row or the third row.

In this embodiment, if the last column from the first row is an even-numbered column, the last compensation data in the first row will not be fetched for each fetch cycle according to the aforementioned fetching manner. Here, the display panel will compulsorily fetch the compensation data in the last column from the first row for each fetch cycle, that is, the last compensation data in the first row is fetched for each fetch cycle. If the last column from the first row is an odd-numbered column, the last compensation data in the first row will surely be fetched for each fetch cycle according to the aforementioned fetching manner. Hence, no matter whether the last column from the first row is an even-numbered column or an odd-numbered column, the last compensation data in the first row will be fetched for each fetch cycle.

In this embodiment, if the last column from the third row is an odd-numbered column, the last compensation data in the third row will not be fetched for each fetch cycle according to the aforementioned fetching manner. Here, the display panel will compulsorily fetch the compensation data in the last column from the third row for each fetch cycle, that is, the last compensation data in the third row is fetched for each fetch cycle. If the last column from the third row is an even-numbered column, the last compensation data in the third row will surely be fetched for each fetch cycle according to the aforementioned fetching manner. Hence, no matter whether the last column from the third row is an odd-numbered column or an even-numbered column, the last compensation data in the third row will be fetched for each fetch cycle.

Besides, the compensation data in the second row and the fourth row of each fragment is not fetched for each fetch cycle.

S130: Permuting the fetched compensation data in sequence so as to create a compressed DeMura table.

In this embodiment, the compensation data 110 fetched through the foregoing steps are permuted in sequence so as to create a compressed DeMura table. Please refer to FIG. 4*c*. By the fetching operation, the compensation data 110 in the compressed DeMura table is about one-fourth of the original DeMura. Therefore, the size of the compressed DeMura table is much lower than the size of the original DeMura table, thereby saving the storage space. In the compressed DeMura table, the quantity of the compensation data 110 in rows numbered 1, 5, 9, . . . is not equal to the quantity of the compensation data 110 in rows numbered 3, 7, 11 . . . .

S140: Storing the compressed DeMura table in the storage device.

In this embodiment, the compressed DeMura table is stored in the storage device. The storage device may be, for example, a flash device. In this embodiment, as the storage space occupied by the compressed DeMura table is much lower than the storage space occupied by the original DeMura table, the space of the storage device can be downsized so as to save cost.

In addition, in this embodiment when all of the fetch cycles have been gone through, there are still k rows of compensation data in the original DeMura table that remain un-fetched. For example, assuming that the total number of rows in the original DeMura table is 4a+k, where k is a positive integer smaller than 4, and a is a positive integer. In this case, after the periodic fetching operation to the original DeMura table has fetched compensation data per fetch cycle, k rows of compensation data are still un-fetched in the end. Thus, the compression method of the invention further includes:

S150: If the last k rows of the original DeMura table are not fetched through all of the fetch cycles, compulsorily fetching compensation data from the last k rows with reference to the fetching manner for corresponding rows for each fetch cycle, where k is a positive integer smaller than 4.

In this embodiment, the last k rows of compensation data are compulsorily fetched with reference to the fetching manner for the fetch cycle. For example, if k is 1, then the last row is fetched with reference to the fetching manner for the first low for each fetch cycle. If k is 2, then the second-to-last row is fetched with reference to the fetching manner for the first low for each fetch cycle, and the last row is fetched with reference to the fetching manner for the second low for each fetch cycle. If k is 3, then the third-to-last row is fetched with reference to the fetching manner for the first low for each fetch cycle, and the second-to-last row is fetched with reference to the fetching manner for the second low for each fetch cycle, and the last row is fetched with reference to the fetching manner for the third low for each fetch cycle. In this manner, the fetching operation to the original DeMura table can be finished accordingly.

In order to facilitate the decompression operation and to allow the decompressed data to be more similar to the original DeMura table, in this embodiment the method further includes:

S160: If the total number of rows of the original DeMura table is an even number, compulsorily making the fetching manner for the last row the same with the fetching manner for the second-to-last row.

In this embodiment, if the total number of rows in the original DeMura table is an even number, the compensation data of the last row will not be fetched according to the aforementioned fetching manner. This embodiment has made amendments to the fetching manner for the last row by compulsorily making the fetching manner for the last row the same with the fetching manner for the second-to-last row. That is, if the last row is the fourth row of a fragment for fetch cycle, the last row will be fetched according to the fetching manner of the second-to-last row, i.e. the third row. That is, the compensation data in the first, second, fourth, sixth, eighth, tenth, . . . columns from the last row are fetched. If the last row is the second row of a fragment for fetch cycle, the last row will be fetched according to the fetching manner of the second-to-last row, i.e. the first row. Likewise, the compensation data of the last column from the last row will be fetched as well.

The Second Embodiment

Figure 4C:
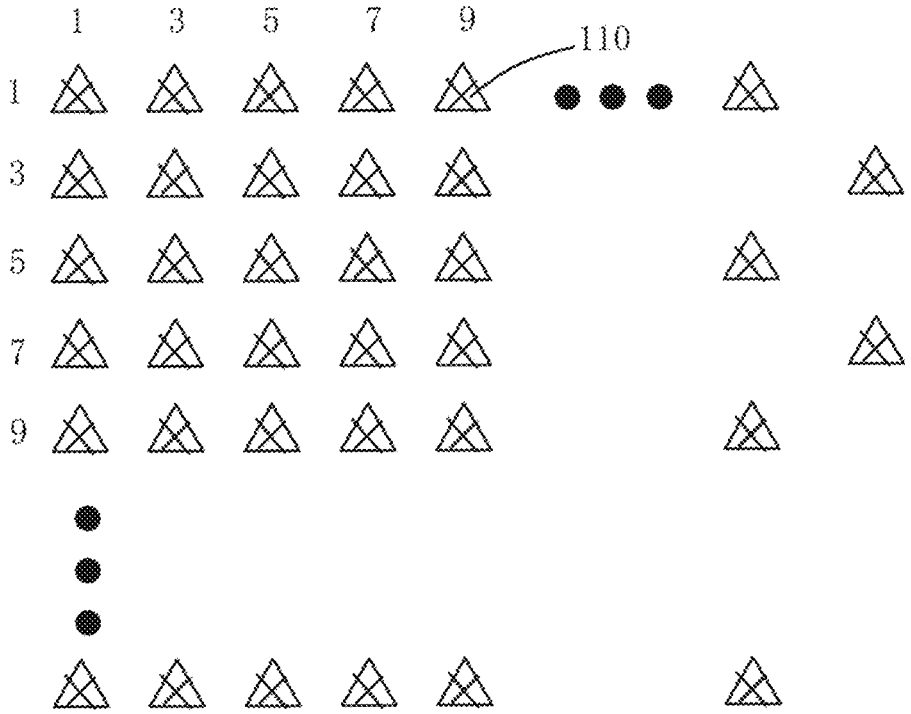
FIG. 4*c* is schematic diagram showing a compressed original DeMura table according to a first embodiment of the invention.
Figure 5:
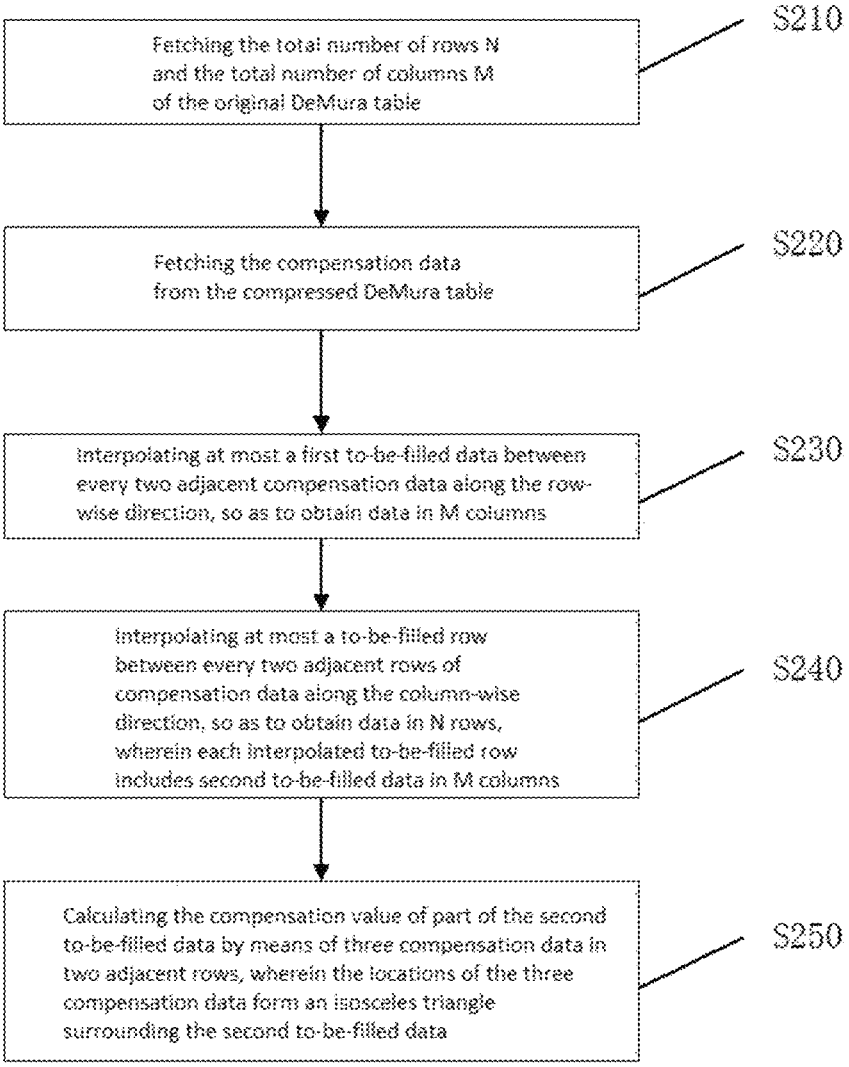
FIG. 5 is a flow chart illustrating the data decompression method for DeMura table according to a second embodiment of the invention.
Figure 6:
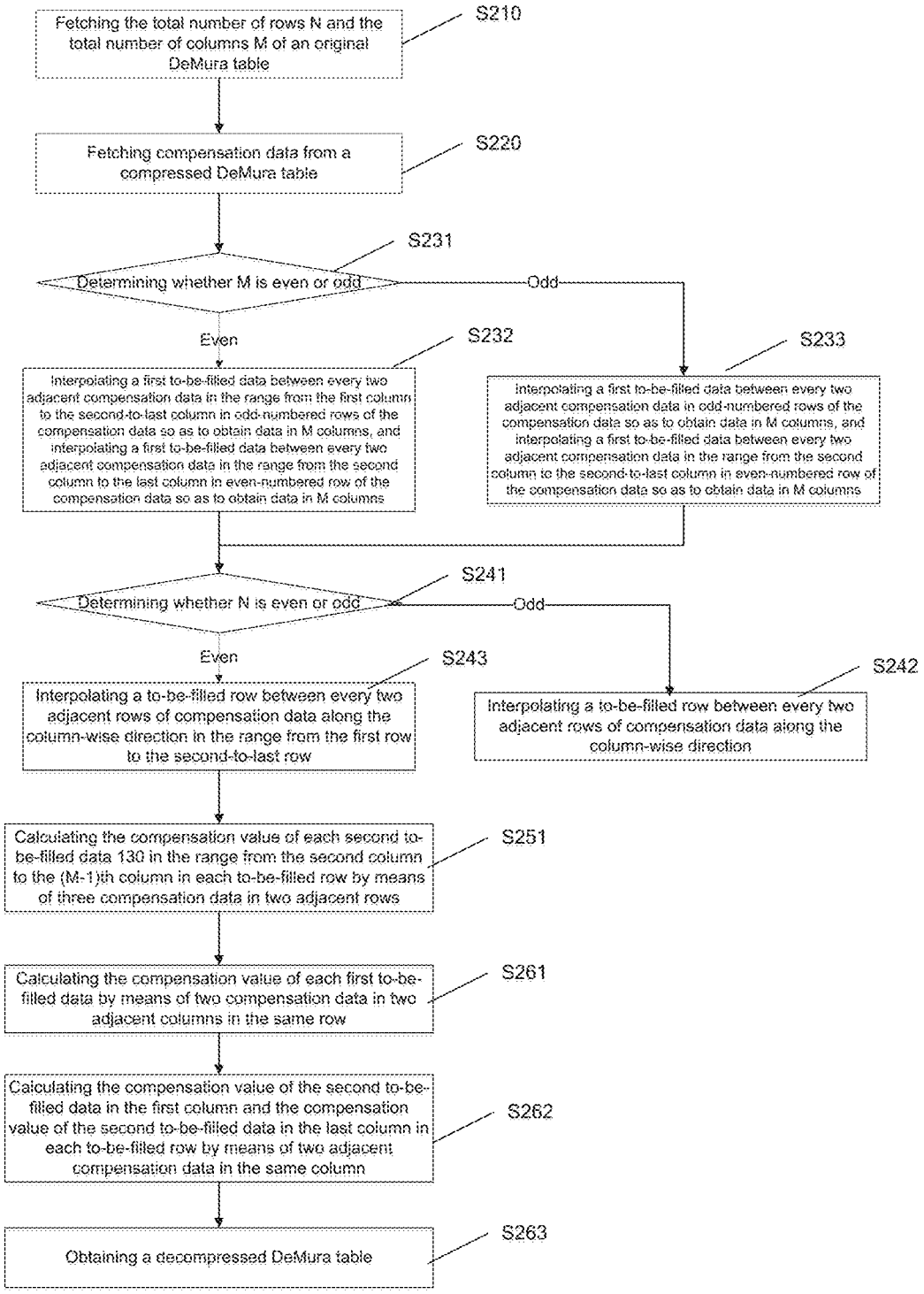
FIG. 6 is a flow chart illustrating the details of the data decompression method for DeMura table according to a second embodiment of the invention.

FIG. 5 shows the data decompression method for DeMura table according to a second embodiment of the invention. The data decompression method for DeMura table according to the second embodiment of the invention corresponds to the data compression method for DeMura table according to the first embodiment of the invention. Please refer to FIG. 4*c* and FIGS. 5-7. In this embodiment, the data decompression method for DeMura table includes the steps of:

Step S210: Fetching the total number of rows N and the total number of columns M of the original DeMura table, wherein N and M both are a positive integer larger than or equal to 2.

In this embodiment, the display panel fetches the total number of rows N and the total number of columns M of the original DeMura table. That is, when it is desired to compress the original DeMura table, the display panel will fetch the total number of row N and the total number of column M of the original DeMura table, and stores N and M. N and M both are a positive integer larger than or equal to 2. N may be, for example, 2, 3, 4, 6, 10, 240, 480, 600, 720, 768, 800, 864, 900, 960, 1024, 1050, 1200, 1536, 1600, and so on. M may be, for example, 2, 3, 4, 6, 10, 320, 400, 640, 800, 1024, 1152, 1280, 1366, 1400, 1440, 1600, 1680, 1920, 2048, 2560.

Step S220: Fetching the compensation data from the compressed DeMura table.

Please refer to FIG. 4*c*. In this embodiment, the display panel fetches the compensation data 110 from the compressed DeMura table. The data quantity of the compressed DeMura table is about one-fourth of the data quantity of the original DeMura table.

Step S230: Interpolating at most a first to-be-filled data between every two adjacent compensation data along the row-wise direction, so as to obtain data in M columns.

Figure 7A:
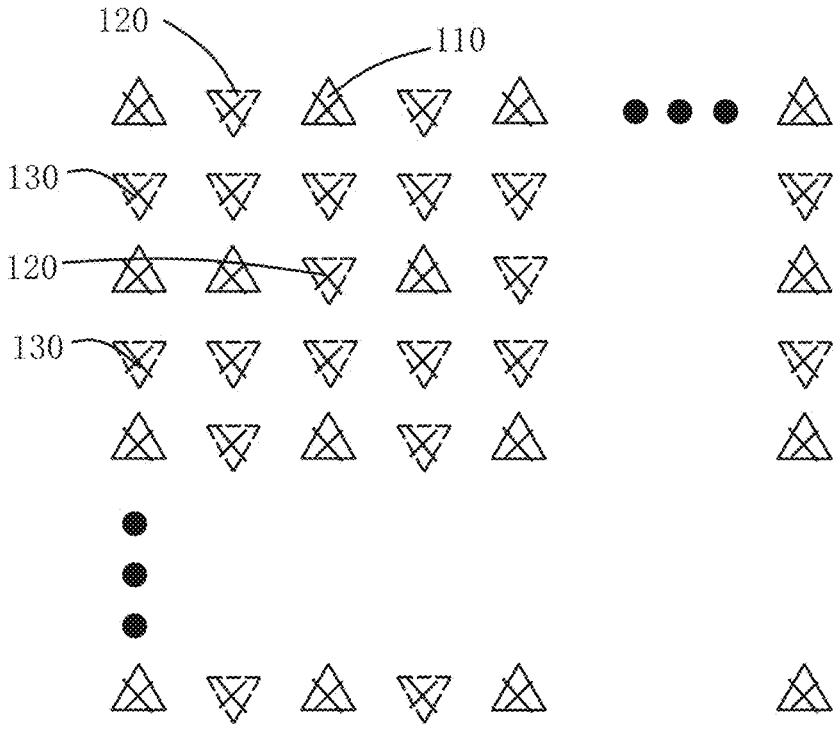
FIG. 7*a* is schematic diagram showing the manner for decompressing a compressed DeMura table according to a second embodiment of the invention.

Please refer to FIG. 7*a*. After the compressed DeMura table is fetched, at most a first to-be-filled data 120 is interpolated between every two adjacent compensation data 110 along the row-wise direction, so as to obtain data in M columns. That is, a first to-be-filled data 120 may be or may not be interpolated between every two adjacent compensation data 110 along the row-wise direction. In this embodiment, assuming the data in the compressed DeMura table is arranged in n rows and m columns, the first to-be-filled data 120 are interpolated in the n rows such that each row has data in M columns.

Concretely speaking, in this embodiment the step S230 further includes:

Step S231; Determining whether M is even or odd; if M is even, the method continues with step S232; if M is odd, the method continues with step S233.

In this embodiment, the processing manner for the total number of columns M is different depending on whether M is odd or even. If M is even, the method continues with step S232. If M is odd, the method continues with step S233.

S232: Interpolating a first to-be-filled data between every two adjacent compensation data in the range from the first column to the second-to-last column in odd-numbered rows of the compensation data so as to obtain data in M columns, and interpolating a first to-be-filled data between every two adjacent compensation data in the range from the second column to the last column in even-numbered row of the compensation data so as to obtain data in M columns.

In this embodiment, if the total number of columns M is even, a first to-be-filled data 120 is interpolated between every two adjacent compensation data 110 in the range from the first column 110 to the second-to-last column 110 in odd-numbered rows of the compensation data so as to obtain data in M columns. Concretely speaking, in this embodiment the compressed DeMura table includes compensation data of n rows. In the first row, the third row, the fifth row, the seventh row, . . . of decompressed DeMura table, the first to-be-filled data 120 is interpolated between every two adjacent compensation data 110 in the range from the first column 110 to the (m−1)th column 110, and the compensation data of the mth column is kept, so as to obtain data in M columns. In the decompressed DeMura table, a first to-be-filled data 120 is interposed between every two adjacent compensation data 110 in the range from the second column 110 to the last column 110 in even-numbered row of the compensation data so as to obtain data in M columns. Concretely speaking, in this embodiment in the second row, the fourth row, the sixth row, the eighth row, . . . of decompressed DeMura table, the first to-be-filled data 120 is interpolated between every two adjacent compensation data 110 in the range from the second column 110 to the mth column 110, and the compensation data of the first column is kept, so as to obtain data in M columns.

S233: Interpolating a first to-be-filled data between every two adjacent compensation data in odd-numbered rows of the compensation data so as to obtain data in M columns, and interpolating a first to-be-filled data between every two adjacent compensation data in the range from the second column to the second-to-last column in even-numbered row of the compensation data so as to obtain data in M columns.

In this embodiment, if the total number of columns M is even, a first to-be-filled data 120 is interpolated between every two adjacent compensation data 110 in odd-numbered rows of the compensation data so as to obtain data in M columns. Concretely speaking, in this embodiment the compressed DeMura table includes compensation data of n rows. In the first row, the third row, the fifth row, the seventh row, . . . of decompressed DeMura table, the first to-be-filled data 120 is interpolated between every two adjacent compensation data 110 in the range from the first column 110 to the mth column 110, so as to obtain data in M columns. In the decompressed DeMura table, a first to-be-filled data 120 is interposed between every two adjacent compensation data 110 in the range from the second column 110 to the second-to-last column 110 in even-numbered row of the compensation data so as to obtain data in M columns. Concretely speaking, in this embodiment in the second row, the fourth row, the sixth row, the eighth row, . . . of decompressed DeMura table, the first to-be-filled data 120 is interpolated between every two adjacent compensation data 110 in the range from the second column 110 to the (m−1)th column 110, and the compensation data of the first column is kept, so as to obtain data in M columns.

S240: Interpolating at most a to-be-filled row between every two adjacent rows of compensation data along the column-wise direction, so as to obtain data in N rows, wherein each interpolated to-be-filled row includes second to-be-filled data in M columns.

In this embodiment, a to-be-filled row may be or may not be interpolated between every two adjacent rows of compensation data along the column-wise direction. If a to-be-filled is interpolated between every two adjacent rows of compensation data along the column-wise direction, each interpolated to-be-filled row includes second to-be-filled data 130 in M columns.

Concretely speaking, in this embodiment the step S240 includes sub-steps of:

S241: Determining whether N is an even or odd. If N is odd, the method continues with the step S242; if N is even, the method continues with the step S243.

In this embodiment, the processing manner for the total number of row N is different depending on whether N is odd or even. If N is odd, the method continues with the step S242; if N is even, the method continues with the step S243.

S242: If N is odd, interpolating a to-be-filled row between every two adjacent rows of compensation data along the column-wise direction.

In this embodiment, if the total number of rows N is odd, a to-be-filled row is interpolated between every two adjacent rows of compensation data along the column-wise direction in the compressed DeMura table. That is, a to-be-filled row is interpolated between every two adjacent rows of compensation data in the range from the first row to the nth row, so as to obtain data in N rows. In this embodiment, each to-be-filled row includes data in M columns.

S243: If N is even, interpolating a to-be-filled row between every two adjacent rows of compensation data along the column-wise direction in the range from the first row to the second-to-last row.

In this embodiment, if the total number of rows N is even, a to-be-filled row is interpolated between every two adjacent rows of compensation data along the column-wise direction in the range from the first row to the second-to-last row in the compressed DeMura table. That is, a to-be-filled row is interpolated between every two adjacent rows of compensation data in the range from the first row to the (n−1)th row, so as to obtain data in N rows. In this embodiment, each to-be-filled row includes data in M columns.

S250: Calculating the compensation value of part of the second to-be-filled data by means of three compensation data in two adjacent rows, wherein the locations of the three compensation data form an isosceles triangle surrounding the second to-be-filled data.

Figure 7B:
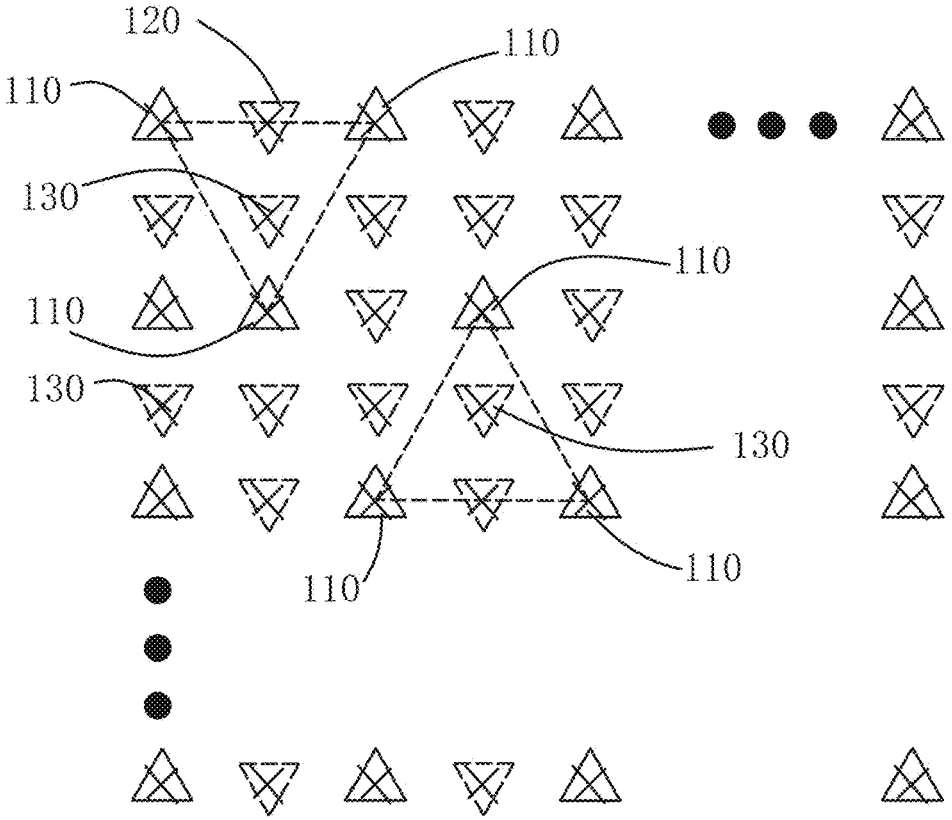
FIG. 7*b* is a schematic diagram showing the manner for calculating the second to-be-filled data according to a second embodiment of the invention.

Please refer to FIG. 7*b*. In this embodiment, each interpolated to-be-filled row contains a plurality of second to-be-filled data 130. The compensation value of part of the second to-be-filled data 130 is calculated by means of three compensation data 110 in two adjacent rows. Here the compensation value of the second to-be-filled data 130 is the mean value of the three compensation data 110. The location of these three compensation data 110 form an isosceles triangle surrounding the second to-be-filled data 130. Next, the calculation of the compensation value of the second to-be-filled data 130 which is labeled with a triangle is illustrated with reference to FIG. 7*b*. In FIG. 7*b*, the data in the previous row of the second to-be-filled data 130 contain two compensation data 110, which are respectively located at the upper-left corner and the upper-right corner of the second to-be-filled data 130. The data in the next row of the second to-be-filled data 130 contain one compensation data 110, which is located directly below the second to-be-filled data 130. The locations of these three compensation data 110 can be connected to form an isosceles triangle surrounding the second to-be-filled data 130. In this embodiment, the mean value of these three compensation data 110 is taken to be the compensation value of the second to-be-filled data 130. Likewise, other second to-be-filled data 130 can be calculated in the same manner. In this embodiment, the compensation value of part of the second to-be-filled data 130 is calculated by means of three compensation data 110 in two adjacent rows, and the locations of the three compensation data 110 form an isosceles triangle surrounding the second to-be-filled data 130. Because the second to-be-filled data 130 is quite near to these three compensation data 110, the compensation value of the second to-be-filled data 130 obtained by calculation is approximate to the real compensation value. Thus, the compensation effect is much better.

Concretely speaking, the step S250 includes sub-steps of:

S251: Calculating the compensation value of each second to-be-filled data 130 in the range from the second column to the (M−1)th column in each to-be-filled row by means of three compensation data in two adjacent rows.

In this embodiment, the compensation value of each second to-be-filled data 130 in the range from the second column to the (M−1)th column in each to-be-filled row is obtained by calculating the mean value of three compensation data in two adjacent rows. Thus, the compensation value of most of the second to-be-filled data 130 can be calculated. Only the compensation value of the second to-be-filled data 130 in the first column and the compensation value of the second to-be-filled data 130 in the Mth column are not calculated.

Besides, in order to obtain the compensation value of the second to-be-filled data 130 in the first column and the compensation value of the second to-be-filled data 130 in the Mth column, and obtain the compensation value of first to-be-filled data 120, in this embodiment the method further includes the steps of:

S261: Calculating the compensation value of each first to-be-filled data by means of two compensation data in two adjacent columns in the same row.

In this embodiment, with respect to the first to-be-filled data 120, its left side contains compensation data 110 and its right side contains compensation data 110. Thus, the compensation value of each first to-be-filled data can be calculated by means of the two compensation data 110 in two adjacent columns in the same row. Here, the compensation value of the first to-be-filled data is calculated as the mean value of the two compensation data 110 in two adjacent columns in the same row. Therefore, the compensation value of each first to-be-filled data can be calculated.

S262: Calculating the compensation value of the second to-be-filled data in the first column and the compensation value of the second to-be-filled data in the last column in each to-be-filled row by means of two adjacent compensation data in the same column.

In this embodiment, compensation data 110 is directly above the second to-be-filled data in the first column 130, and another compensation data 110 is directly below the second to-be-filled data in the first column 130. Thus, the compensation value of the second to-be-filled data in the first column is calculated by means of two adjacent compensation data in the same column, in which the compensation value is the mean value of the two adjacent compensation data 110. Likewise, compensation data 110 is directly above the second to-be-filled data in the last column 130, and another compensation data 110 is directly below the second to-be-filled data in the last column 130. Thus, the compensation value of the second to-be-filled data in the last column is calculated by means of two adjacent compensation data in the same column, in which the compensation value is the mean value of the two adjacent compensation data 110.

S263: Obtaining a decompressed DeMura table.

Through the foregoing steps, the compensation values of all the first to-be-filled compensation data and all the second to-be-filled compensation data can be calculated, thereby obtaining a decompressed DeMura table. The obtained DeMura table includes compensation data 110 in N rows and M columns. With the use of the DeMura table, we can make compensation to the display panel. Also, the data in the obtained DeMura table is quite similar to the data in the original DeMura table. Thus, the invention can provide better compensation effect compared to the prior art.

It is to be noted that each embodiment of the invention is described in a progressive manner. Each embodiment has put focus on the difference with other embodiments, while the features common to all embodiments are purported to be understood by cross-referencing to related embodiments. As to the apparatus, it is not intended to dwell upon the apparatus because the basic principle of the apparatus is similar to that of the method. The knowledge of apparatus related to the invention can be understood with reference to the embodiment embodying the method of the invention.

The above descriptions only disclose a preferred embodiment of the invention. Certainly, the scope of the invention is not to be limited to the embodiments disclosed herein. The equivalent alterations to the embodiments are still within the scope of the invention.

What is claimed is:

1. A display panel compensation method using data compression on DeMura table, comprising the steps of:

photographing a grayscale screen of a display panel by a camera to obtain a Mura pattern;

acquiring an original DeMura table of the display panel in accordance with the Mura pattern;

based on the original DeMura table, designating compensation data in four neighboring rows in the original DeMura table as a fragment to be fetched in a fetch cycle and periodically fetching compensation data per fetch cycle;

permuting fetched compensation data in sequence so as to create a compressed DeMura table;

storing the compressed DeMura table in a storage device; and making compensation to the display panel while displaying on the display panel in accordance with the compressed DeMura table;

wherein the step of periodically fetching compensation data per fetch cycle includes sub-steps of:

fetching the compensation data in odd-numbered columns from the first row of the original DeMura table; and fetching the compensation data in even-numbered columns from the third row and fetching the compensation data in the first column from the third row of the original DeMura table.

2. The display panel compensation method using data compression on DeMura table according to claim 1, wherein the method starts periodically fetching the compensation data from the first row of each fragment per fetch cycle.

3. The display panel compensation method using data compression on DeMura table according to claim 2, further comprising the step of:

if the total number of rows in the original DeMura table is an even number, compulsorily making the fetching manner for the last row the same with the fetching manner for the second-to-last row.

4. The display panel compensation method using data compression on DeMura table according to claim 1, further comprising the step of:

if the last k rows of the original DeMura table is not fetched through all of the fetch cycles, compulsorily fetching compensation data from the last k rows with reference to the fetching manner for corresponding rows for each fetch cycle, where k is a positive integer smaller than 4.

5. The display panel compensation method using data compression on DeMura table according to claim 4, further comprising the step of:

if the total number of rows in the original DeMura table is an even number, compulsorily making the fetching manner for the last row the same with the fetching manner for the second-to-last row.

6. The display panel compensation method using data compression on DeMura table according to claim 1, wherein the step of periodically fetching compensation data according to the fetch cycle further comprising the sub-step of:

if the compensation data in the last column from the first row or the third row of each fragment are not fetched, compulsorily fetching the compensation data in the last column from the first row or the third row.

7. The display panel compensation method using data compression on DeMura table according to claim 6, further comprising the step of:

if the total number of rows in the original DeMura table is an even number, compulsorily making the fetching manner for the last row the same with the fetching manner for the second-to-last row.

8. The display panel compensation method using data compression on DeMura table according to claim 1, further comprising the step of:

if the total number of rows in the original DeMura table is an even number, compulsorily making the fetching manner for the last row the same with the fetching manner for the second-to-last row.

9. A display panel compensation method using data decompression on DeMura table, comprising the steps of:

performing a data decompression method, comprising:

fetching the total number of rows N and the total number of columns M of an original DeMura table, wherein both N and M are a positive integer larger than or equal to 2;

fetching compensation data from a compressed DeMura table;

interpolating at most a first to-be-filled data between every two adjacent compensation data of the compressed DeMura table along a row-wise direction, so as to obtain data in M columns;

interpolating at most a to-be-filled row between every two adjacent rows of compensation data of the compressed DeMura table along a column-wise direction, so as to obtain data in N rows, wherein each interpolated to-be-filled row includes second to-be-filled data in M columns; and calculating compensation value of part of the second to-be-filled data by means of three compensation data in two adjacent rows, wherein locations of the three compensation data form an isosceles triangle surrounding the second to-be-filled data; and making compensation to the display panel while displaying on the display panel in accordance with the data obtained by the data decompression method.

10. The display panel compensation method using data decompression on DeMura table according to claim 9, wherein the step of interpolating at most a first to-be-filled data between every two adjacent compensation data of the compressed DeMura table along a row-wise direction so as to obtain data in M columns includes sub-steps of:

determining whether M is even or odd;

if M is even, interpolating a first to-be-filled data between every two adjacent compensation data in the range from the first column to the second-to-last column in odd-numbered rows of the compensation data so as to obtain data in M columns, and interpolating a first to-be-filled data between every two adjacent compensation data in the range from the second column to the last column in even-numbered row of the compensation data so as to obtain data in M columns; and if M is odd, interpolating a first to-be-filled data between every two adjacent compensation data in odd-numbered rows of the compensation data so as to obtain data in M columns, and interpolating a first to-be-filled data between every two adjacent compensation data in the range from the second column to the second-to-last column in even-numbered row of the compensation data so as to obtain data in M columns.

11. The display panel compensation method using data decompression on DeMura table according to claim 9, wherein the step of interpolating at most a to-be-filled row between every two adjacent rows of compensation data of the compressed DeMura table along a column-wise direction, so as to obtain data in N rows includes sub-steps of:

determining whether N is even or odd;

if N is odd, interpolating a to-be-filled row between every two adjacent rows of compensation data along the column-wise direction; and if N is even, interpolating a to-be-filled row between every two adjacent rows of compensation data along the column-wise direction in the range from the first row to the second-to-last row.

12. The display panel compensation method using data decompression on DeMura table according to claim 9, wherein the step of calculating compensation value of part of the second to-be-filled data by means of three compensation data in two adjacent rows includes the sub-step of:

calculating the compensation value of each second to-be-filled data in the range from the second column to the (M−1)th column in each to-be-filled row by means of three compensation data in two adjacent rows.

13. The display panel compensation method using data decompression on DeMura table according to claim 9, further comprising the steps of:

calculating the compensation value of each first to-be-filled data by means of two compensation data in two adjacent columns in the same row;

calculating the compensation value of the second to-be-filled data in the first column and the compensation value of the second to-be-filled data in the last column in each to-be-filled row by means of two adjacent compensation data in the same column; and obtaining a decompressed DeMura table.

* * * * *